US008882250B2

(12) United States Patent
Mitsuo

(10) Patent No.: US 8,882,250 B2
(45) Date of Patent: Nov. 11, 2014

(54) LIQUID DROPLET DISCHARGING APPARATUS

(71) Applicant: Seiko Epson Corporation, Tokyo (JP)

(72) Inventor: Noritaka Mitsuo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/082,730

(22) Filed: Nov. 18, 2013

(65) Prior Publication Data

US 2014/0160209 A1 Jun. 12, 2014

(30) Foreign Application Priority Data

Dec. 12, 2012 (JP) ..... 2012-271118

(51) Int. Cl.
*B41J 2/175* (2006.01)
*B41J 2/18* (2006.01)

(52) U.S. Cl.
CPC ..... *B41J 2/175* (2013.01); *B41J 2/17596* (2013.01); *B41J 2/18* (2013.01)
USPC ..... 347/85

(58) Field of Classification Search
CPC ..... B41J 2/175; B41J 2/18; B41J 2/17596; B41J 2202/12
USPC ..... 347/65, 84, 85
See application file for complete search history.

(56) References Cited

U.S. PATENT DOCUMENTS 8,430,486 B2 * 4/2013 Serizawa et al. ..... 347/86
2012/0188316 A1 7/2012 Matsuoka et al.

FOREIGN PATENT DOCUMENTS

JP 2012-152972 A 8/2012

* cited by examiner

*Primary Examiner* — An Do
(74) *Attorney, Agent, or Firm* — Global IP Counselors, LLP

(57) ABSTRACT

A liquid droplet discharging apparatus includes an ink tank configured to retain ink, a head configured to discharge the ink, an ink supply path configured to supply the ink from the ink tank to the head, and a shape changing section configured to change a shape of the ink supply path such that differences in elevation are formed in a direction of gravity in the ink supply path.

8 Claims, 8 Drawing Sheets

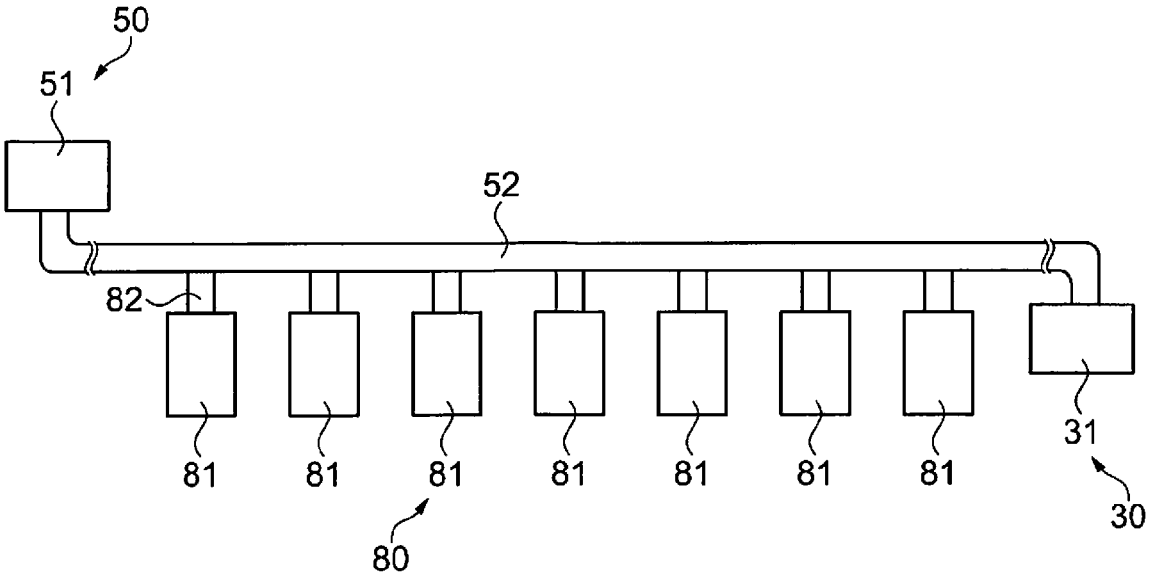
Fig. 2
Fig. 3A
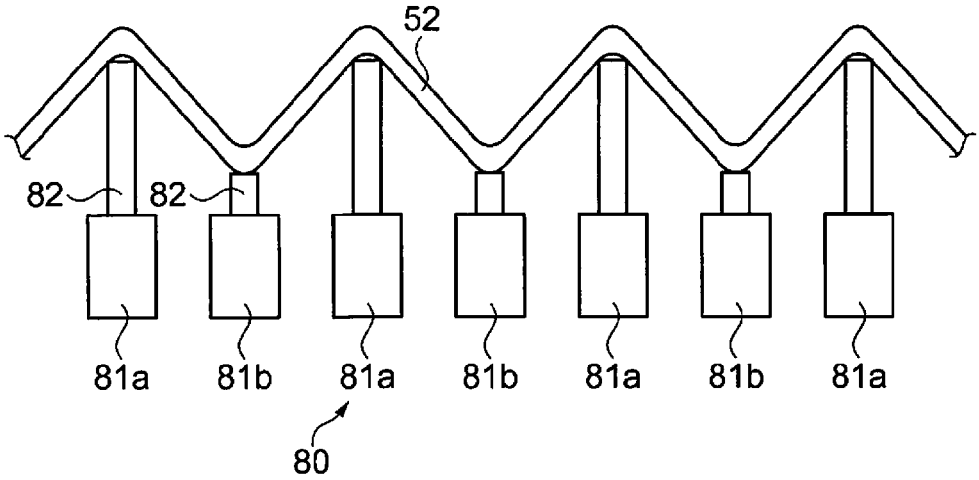
Fig. 3B
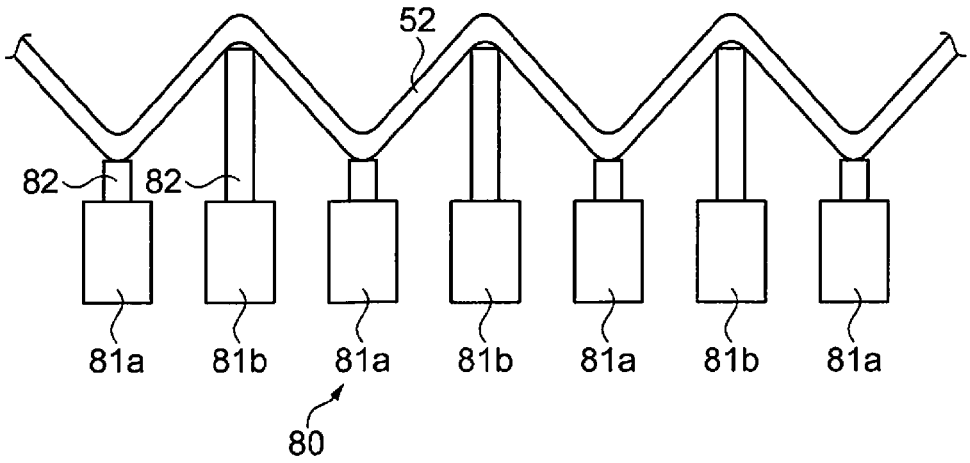

LIQUID DROPLET DISCHARGING APPARATUS

CROSS-REFERENCE TO RELATED APPLICATIONS

This application claims priority to Japanese Patent Application No. 2012-271118 filed on Dec. 12, 2012. The entire disclosure of Japanese Patent Application No. 2012-271118 is hereby incorporated herein by reference.

BACKGROUND

1. Technical Field

The present invention relates to a liquid droplet discharging apparatus.

2. Related Art

In the prior art, techniques are known for eliminating sedimentation of components which are included in ink inside a flow path. For example, Japanese Unexamined Patent Application Publication No. 2012-152972 describes a flow path unit where discharging liquid is circulated inside a flow path tube by connecting a pump to the flow path tube which feeds ink in the horizontal direction and driving the pump.

SUMMARY

However, in a case where the flow path unit described above is applied to, for example, an industrial printing apparatus, there is a problem in that a long time is required to perform sediment removal by circulating the ink inside the flow path tube since the flow path tube which is arranged in the horizontal direction is comparatively long.

The present invention was carried out in order to solve at least a portion of the problems described above and it is possible to realize the present invention in the following formats or aspects.

A liquid droplet discharging apparatus according to the present aspect includes an ink tank configured to retain ink, a head configured to discharge the ink, an ink supply path configured to supply the ink from the ink tank to the head, and a shape changing section configured to change a shape of the ink supply path such that differences in elevation are formed in a direction of gravity in the ink supply path.

According to the present aspect, differences in elevation are formed by changing the shape of the ink supply path using the shape changing section. Then, sedimentation components which are included in the ink are moved from a high location to a low location. Due to this, it is possible to eliminate sedimentation which occurs inside the ink supply path by stirring the ink. In addition, it is possible to prevent sedimentation inside the ink supply path by changing the shape of the ink supply path before there is sedimentation of the components which are included in the ink inside the ink supply path.

The shape changing section of the liquid droplet discharging apparatus according to the aspect described above includes a downward pressing part which presses down the ink supply path in the direction of gravity.

According to the present aspect, differences in elevation are formed by pressing down the ink supply path. Due to this, it is possible to eliminate sedimentation.

The shape changing section of the liquid droplet discharging apparatus according to the aspects described above is a plurality of solenoids and the solenoids are arranged along the ink supply path.

According to the present aspect, it is possible to easily create differences in elevation in the ink supply path by driving the plurality of solenoids which are arranged along the ink supply path.

In addition, among the solenoids which are adjacent in the liquid droplet discharging apparatus according to the aspects described above, one solenoid is pressed up and the other solenoid is pressed down.

According to the present aspect, it is possible to form differences in elevation uniformly in the ink supply path.

In addition, the liquid droplet discharging apparatus according to the aspects described above is provided with a bypass flow path which is connected with the ink supply path, where the ink is circulated in a closed flow path between the ink supply path and the bypass flow path.

According to the present aspect, since the ink is circulated in the ink supply path and the bypass flow path, a stirring removal effect is improved and it is possible to shorten the time for sedimentation elimination.

BRIEF DESCRIPTION OF THE DRAWINGS

Referring now to the attached drawings which form a part of this original disclosure:

FIG. 2 is a schematic diagram illustrating a configuration of a shape changing unit according to the first embodiment.

FIGS. 3A and 3B are schematic diagrams illustrating a method of operating the liquid droplet discharging apparatus according to the first embodiment.

DETAILED DESCRIPTION OF EXEMPLARY EMBODIMENTS

Below, first and second embodiments of the present invention will be described with reference to the diagrams. Here, since each of the members and the like is set to a size which is able to be recognized in each of the following diagrams, the measurements of each of the members and the like are shown to be different to the actual measurements.

First Embodiment

Firstly, a configuration of a liquid droplet discharging apparatus according to the first embodiment will be described. The liquid droplet discharging apparatus is provided with an ink tank which retains ink, a head which discharges the ink, an ink supply path which supplies the ink from the ink tank to the head, and a shape changing section which changes the shape of the ink supply path such that differences in elevation are formed in the direction of gravity in the ink supply path. Below, description will be given in detail.

Figure 1:
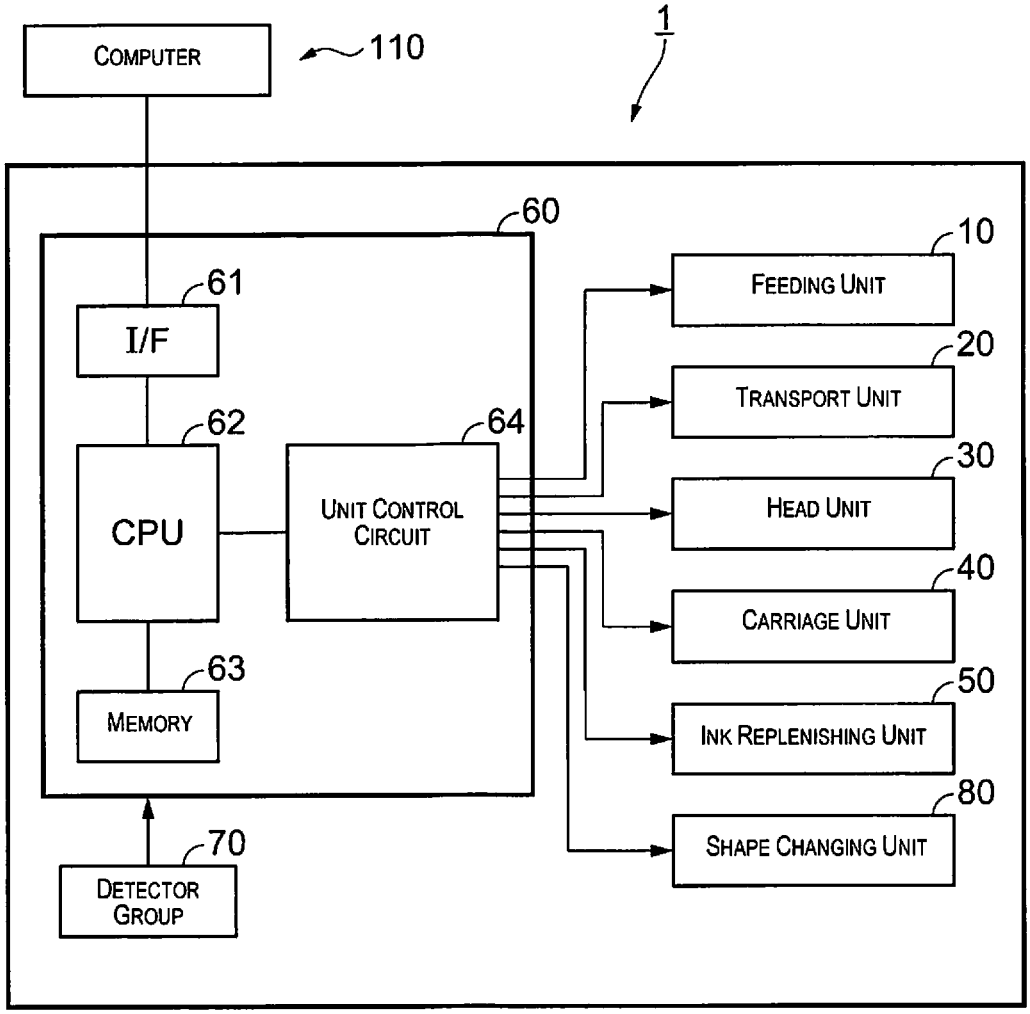
FIG. 1 is a block diagram illustrating a configuration of a liquid droplet discharging apparatus according to a first embodiment.

FIG. 1 is a block diagram illustrating a configuration of the liquid droplet discharge apparatus according to the present embodiment. In addition, FIG. 2 is a schematic diagram illustrating a configuration of the shape changing unit according to the present embodiment. A liquid droplet discharging apparatus 1 is, for example, an ink jet printer, and performs printing onto a printing medium by discharging ink from a head which will be described later. As shown in FIG. 1 and FIG. 2, the liquid droplet discharging apparatus 1 is provided with a feeding unit 10, a transport unit 20, a head unit 30, a carriage unit 40, an ink replenishing unit 50, a shape changing unit 80 as the shape changing section, a controller 60, and a detector group 70.

The feeding unit 10 feeds a printing medium with a roll shape which is not shown in the diagram to the transport unit 20 which will be described later. The transport unit 20 transports the printing medium which is sent from the feeding unit 10 along a transport flow path which is set in advance.

The head unit 30 forms an image at a predetermined location on the printing medium which is transported on the transport flow path. The head unit 30 is provided with a head 31 and forms an image by discharging the ink, which is supplied, onto the printing medium. The carriage unit 40 holds the head 31 and moves in a predetermined direction. In this manner, it is possible to form an image in the planar direction of the printing medium by the head 31 being held and moved in the predetermined direction.

The ink replenishing unit 50 is a unit for supplying ink to the head 31. The ink replenishing unit 50 is provided with an ink cartridge 51 and an ink supply path 52 which is a through path for ink. Here, a tube is used in the ink supply path 52 in the present embodiment.

The shape changing unit 80 changes the shape of the ink supply path 52 such that differences in elevation are formed in the direction of gravity. A detailed description of the shape changing unit 80 will be given later.

The controller 60 is a control unit for performing control of the liquid droplet discharging apparatus 1. The controller 60 has an interface section 61, a CPU 62, a memory 63, and a unit control circuit 64. The interface section 61 is a computation processing unit for performing control of a computer 110 which is an external apparatus and the entirety of the liquid droplet discharging apparatus 1. The memory 63 is a memory for ensuring a region which retains the programs of the CPU 62, an operation region, and the like. The CPU 62 controls each of the units using the unit control circuit 64 according to the programs which are retained in the memory 63.

The detector group 70 monitors the status inside the liquid droplet discharging apparatus 1. Due to this, precise transport control of the printing medium such as meandering correction is performed by detecting the leading edge or the like of the printing medium.

In the liquid droplet discharging apparatus 1 of the present embodiment, white ink is used in addition to color inks (yellow, magenta, cyan, and black). The white ink is, for example, an ink for printing a background color (white) for a color image when performing printing onto a transparent medium. Then, it is possible for the color image to be easier to see by setting the background to be white. Here, the white ink includes a white pigment (a sedimentary material) as the coloring material. Examples of the white pigment include metal oxides, barium sulfate, calcium carbonate, and the like. Examples of the metal oxides include titanium dioxide, zinc oxide, silica, alumina, magnesium oxide, and the like. Out of these, titanium dioxide is preferable from the point of view of superior whiteness.

The white ink is sedimentary ink which has a property where it is easy for the white pigment which is included in the white ink to become sediment when left to stand for a long time. Here, a sedimentary ink is an ink where the absorbance is 95% or less within 24 hours. Then, in a case where the ink supply path 52 is arranged to extend in the horizontal or substantially horizontal direction, white pigment sedimentation occurs when the ink which is contained inside the ink supply path 52 is left to stand for a long time, and differences in concentration are generated in the ink inside the ink supply path 52 at the upper side and the lower side in the vertical direction. In particular, in a case where the ink is pigment ink such as white ink, the differences in concentration due to sedimentation are remarkably apparent. Then, when an image is printed using the ink after such sedimentation, there is a concern that this will lead to a decrease in image quality since there is a gradual change to an image where the concentration is different to the original image with the passage of time.

Next, the configuration of the shape changing unit as the shape changing section will be described. As shown in FIG. 2, the shape changing unit 80 includes a downward pressing part which presses down the ink supply path 52 in the direction of gravity. In more detail, the shape changing unit 80 according to the present embodiment includes a plurality of solenoids 81, and the solenoids 81 are arranged along the ink supply path 52 as shown in FIG. 2. The solenoids 81 of the present embodiment are provided with plungers 82 which are mechanism members which reciprocate in a straight line. Then, the plurality of solenoids 81 are aligned according to the length of the ink supply path 52.

Next, a method of operating the shape changing unit as the shape changing section will be described. FIG. 3 is a schematic diagram illustrating a method of operating the shape changing unit. In the present embodiment, the operation is carried out such that, among solenoids 81*a* and 81*b* which are arranged to be adjacent, one solenoid 81*a* (81*b*) is pressed up and the other solenoid 81*b* (81*a*) is pressed down. In detail, the plurality of solenoids 81*a* and 81*b* are alternately arranged along the ink supply path 52 as shown in FIG. 3A. Then, the solenoids 81*a* are driven at a first timing based on a driving signal from the controller 60. At this time, the solenoids 81*b* are not driven. Due to this, the solenoids 81*a* which are driven extend upward in the vertical direction and a portion of the ink supply path 52 is pressed up as shown in FIG. 3A. On the other hand, since the solenoids 81*b* are not driven, the ink supply path 52 is held in the initial position. Due to this, the shape of the ink supply path 52 is changed such that differences in elevation are formed in the direction of gravity. At this time, sedimentary material moves from a high position toward a low position in the ink supply path 52.

Next, the solenoids 81*a* are pressed down and the solenoids 81*b* are pressed up at a second timing, which is after a predetermined time passes from the first timing, based on a driving signal from the controller 60. Due to this, as shown in FIG. 3B, the solenoids 81*a* move from the top to the bottom in the vertical direction, and accompanying this, the portion of the ink supply path 52 which corresponds to the solenoids 81*a* is pressed up from the top to the bottom. On the other hand, the solenoids 81*b* extend upward in the vertical direction and a portion of the ink supply path 52 is pressed up. Due to this, the shape of the ink supply path 52 is changed such that differences in elevation are formed in the direction of gravity.

At this time, sedimentary material moves from a high position toward a low position in the ink supply path 52.

After this, the solenoids 81*a* and the solenoids 81*b* are alternately moved up and down as shown in FIGS. 3A and 3B. Here, it is possible to appropriately set driving of the solenoids 81*a* and the solenoids 81*b* to a predetermined number of times, a predetermined time, or the like. Then, stirring is carried out by alternately moving the solenoids 81*a* and the solenoids 81*b* up and down and moving sedimentary material inside the ink supply path 52.

Above, according to the present embodiment, it is possible to obtain the following effects.

By alternately driving the solenoids 81*a* and 81*b*, it is possible to easily create differences in elevation with regard to the ink supply path 52. Due to this, stirring is carried out due to there being movement of sedimentary material inside the ink supply path 52. As a result, it is possible to quickly eliminate sediment in the ink supply path 52. In addition, it is possible to prevent sedimentation of sedimentary material inside the ink supply path 52 in advance by driving the solenoids 81*a* and 81*b* before there is white sedimentation which is included inside the ink supply path 52.

Second Embodiment

Figure 4:
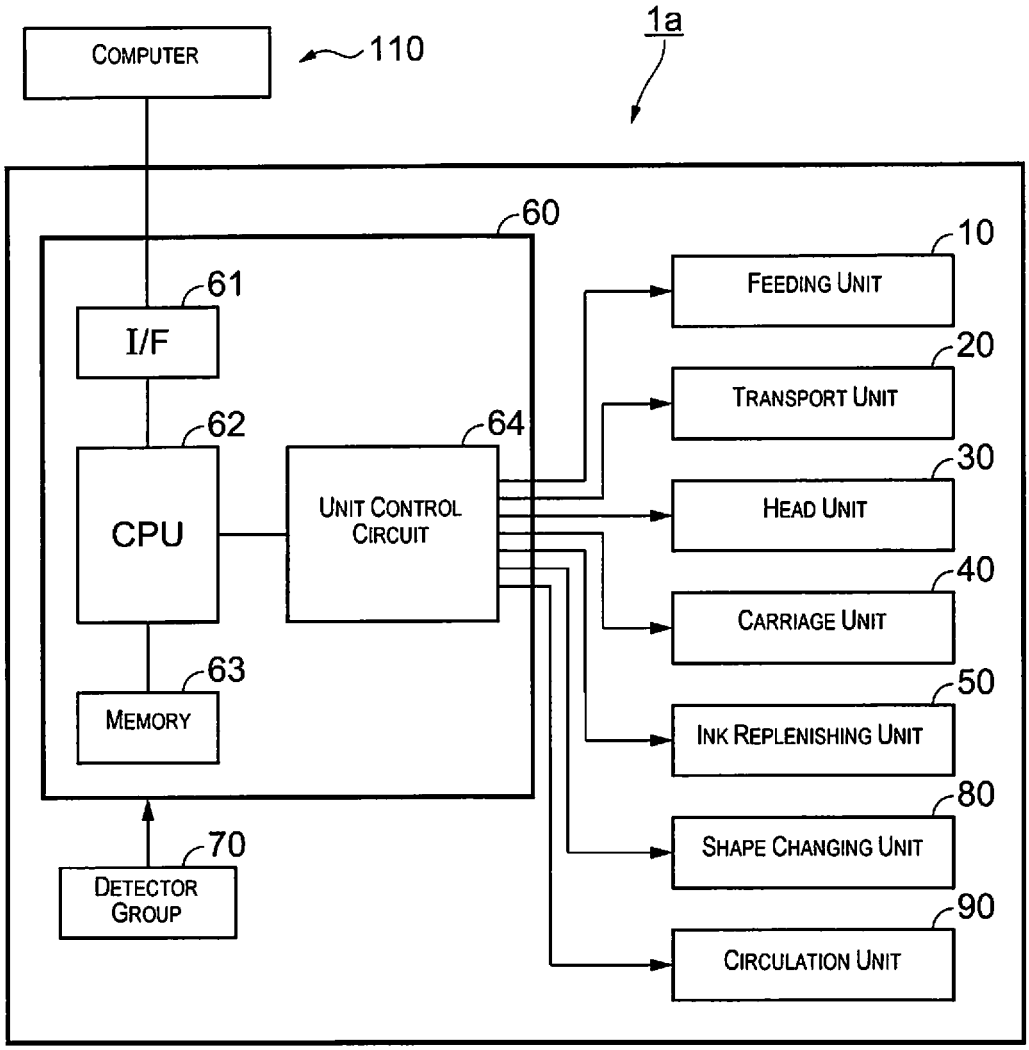
FIG. 4 is a block diagram illustrating a configuration of a liquid droplet discharging apparatus according to a second embodiment.

Next, a configuration of a liquid droplet discharging apparatus according to the second embodiment will be described. FIG. 4 is a block diagram illustrating a configuration of the liquid droplet discharge apparatus according to the present embodiment. A liquid droplet discharging apparatus 1*a* according to the present embodiment is further provided with a circulation unit 90 in addition to the configuration of the liquid droplet discharging apparatus 1 according to the first embodiment described above. Below, description will be given in detail. Here, description of the configuration according to the first embodiment will be omitted.

Figure 5:
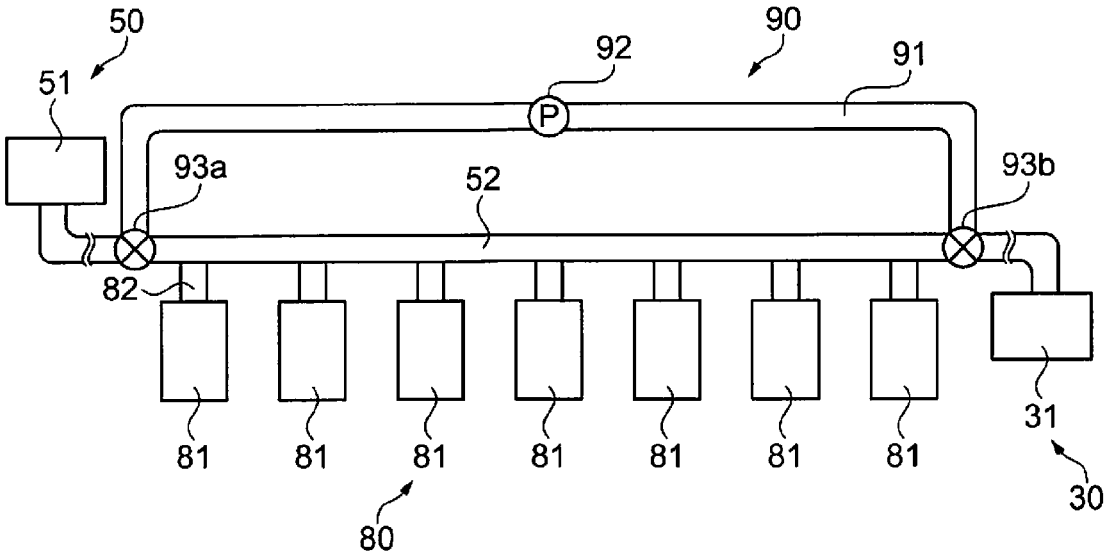
FIG. 5 is a schematic diagram illustrating a configuration of the surroundings of a shape changing unit according to the second embodiment.

The circulation unit 90 circulates the ink in the flow path which includes the ink supply path 52. FIG. 5 is a schematic diagram illustrating configurations of the shape changing unit and the circulation unit according to the present embodiment. The shape changing unit 80 includes the plurality of solenoids 81 and the solenoids 81 are arranged along the ink supply path 52. The solenoids 81 of the present embodiment are provided with the plungers 82 which are mechanism members which reciprocate in a straight line. Then, the plurality of solenoids 81 are aligned according to the length of the ink supply path 52.

The circulation unit 90 is provided with a bypass flow path 91 which is connected with the ink supply path 52 and has a configuration where ink is circulated in a closed flow path between the ink supply path 52 and the bypass flow path 91. The bypass flow path 91 of the circulation unit 90 of the present embodiment is connected with a solenoid valve 93*a* which is provided in the vicinity of one end of a region where the solenoids 81 are aligned and a solenoid valve 93*b* which is provided in the vicinity of the other end of the region where the solenoids 81 are aligned. Then, a pump 92 is provided in the middle of the bypass flow path 91.

Each of the solenoid valves 93*a* and 93*b* are controlled to open and close based on a driving signal from the controller 60. For example, in a case where each of the solenoid valves 93*a* and 93*b* is opened, the ink which is supplied from the ink cartridge 51 is supplied to the head 31 by passing through the ink supply path 52. On the other hand, in a case where each of the solenoid valves 93*a* and 93*b* is closed, the ink which is supplied from the ink cartridge 51 is supplied to the ink supply path 52 and the bypass flow path 91. That is, the closed flow path, which is closed due to the ink supply path 52 and the bypass flow path 91, is formed. Then, by driving the pump 92 in the closed flow path, the ink flows in a certain direction. Due to this, it is possible to stir the ink by circulating the ink in the closed flow path. Here, the solenoid valves 93*a* and 93*b* are used in the circulation unit 90 in the present embodiment, but, for example, solenoid valves which are driven by a motor or the like may be used.

Next, a method of operating the shape changing unit as the shape changing section will be described. FIG. 6 is a schematic diagram illustrating a method of operating the shape changing unit. In the present embodiment, firstly, the closed flow path is formed due to the ink supply path 52 and the bypass flow path 91. In detail, the ink which flows from the ink cartridge (which is not shown in the diagram) via the ink supply path 52 is introduced into the bypass flow path 91 by closing the solenoid valve 93*b*. Then, the pump 92 is driven and the ink flows to the solenoid valve 93*a* side. After the flowing ink reaches the solenoid valve 93*a*, the solenoid valve 93*a* is closed and the ink flow between the ink cartridge 51 and the solenoid valve 93*a* is stopped. Due to this, the closed flow path is formed due to the ink supply path 52 and the bypass flow path 91. Then, the ink flows in one direction inside the closed flow path due to driving of the pump 92. Due to this, the ink is stirred.

Figure 6A:
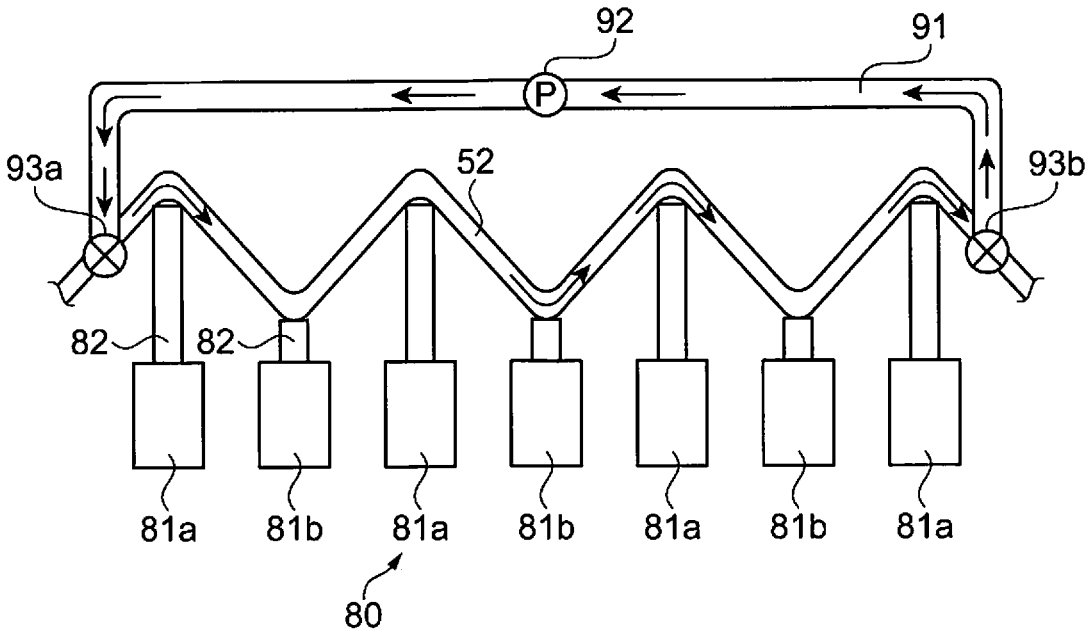
FIGS. 6A and 6B are schematic diagrams illustrating a method of operating the liquid droplet discharging apparatus according to the second embodiment.

Furthermore, the operation is carried out in the present embodiment such that, among the solenoids 81*a* and 81*b* which are arranged to be adjacent, one solenoid 81*a* (81*b*) is pressed up and the other solenoid 81*b* (81*a*) is pressed down. In detail, the plurality of solenoids 81*a* and 81*b* are alternately arranged along the ink supply path 52 as shown in FIG. 6A. Then, the solenoids 81*a* are driven at the first timing based on a driving signal from the controller 60 and the solenoids 81*b* are not driven. Due to this, the solenoids 81*a* which are driven extend upward in the vertical direction and a portion of the ink supply path 52 is pressed up as shown in FIG. 6A. On the other hand, since the solenoids 81*b* are not driven, the ink supply path 52 is held in the initial position. Due to this, the shape of the ink supply path 52 is changed such that differences in elevation are formed in the direction of gravity. At this time, sedimentary material moves from a high position toward a low position in the ink supply path 52.

Figure 6B:
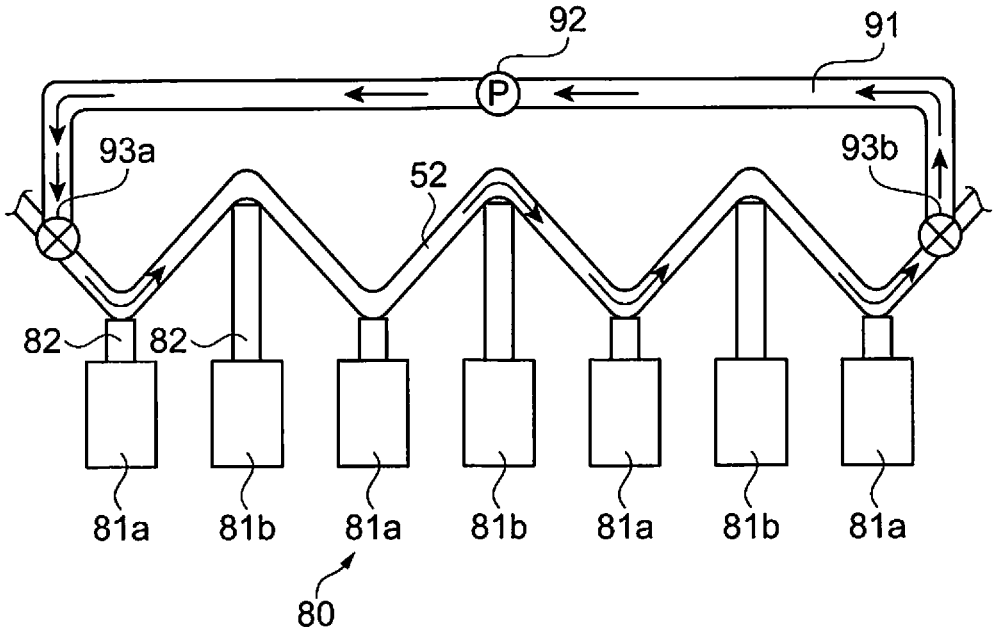

Next, the solenoids 81*a* are pressed down and the solenoids 81*b* are pressed up at the second timing, which is after a predetermined time passes from the first timing, based on a driving signal from the controller 60. Due to this, as shown in FIG. 6B, the solenoids 81*a* move downward in the vertical direction, and accompanying this, the portion of the ink supply path 52 which corresponds to the solenoids 81*a* is pressed up from the top to the bottom. On the other hand, the solenoids 81*b* extend upward in the vertical direction and a portion of the ink supply path 52 is pressed up. Due to this, the shape of the ink supply path 52 is changed such that differences in elevation are formed in the direction of gravity. At this time, sedimentary material moves from a high position toward a low position in the ink supply path 52.

After this, the solenoids 81*a* and the solenoids 81*b* are alternately moved up and down while the pump 92 is driven in the closed flow path as shown in FIGS. 6A and 6B. Here, it is possible to appropriately set driving of the solenoids 81*a* and the solenoids 81*b* to a predetermined number of times, a predetermined time, or the like. Then, stirring is carried out by alternately moving the solenoids 81*a* and the solenoids 81*b* up and down and moving sedimentary material inside the ink supply path 52.

Above, according to the present embodiment, it is possible to obtain the following effects in addition to the effects of the first embodiment.

The closed flow path is formed due to the ink supply path 52 and the bypass flow path 91 and ink flows inside the closed flow path by the pump 92 being driven. Furthermore, at this time, it is possible to quickly perform a sediment removal process with regard to the ink where pigment becomes sediment by alternately driving the solenoids 81*a* and 81*b*. Here, in a case where the bypass flow path 91 includes a location which is arranged in the horizontal direction, it is possible to drive the solenoids 81*a* and 81*b* in the same manner as the ink supply path 52 for the location although it is not shown in the diagrams and it is effective for the sediment removal process with regard to the ink where pigment becomes sediment inside the bypass flow path 91.

Here, the present invention is not limited to the embodiments described above and it is possible to add various types of modifications, alterations, and the like to the embodiments described above. Modified examples are described below.

Modified Example 1

Figure 7A:
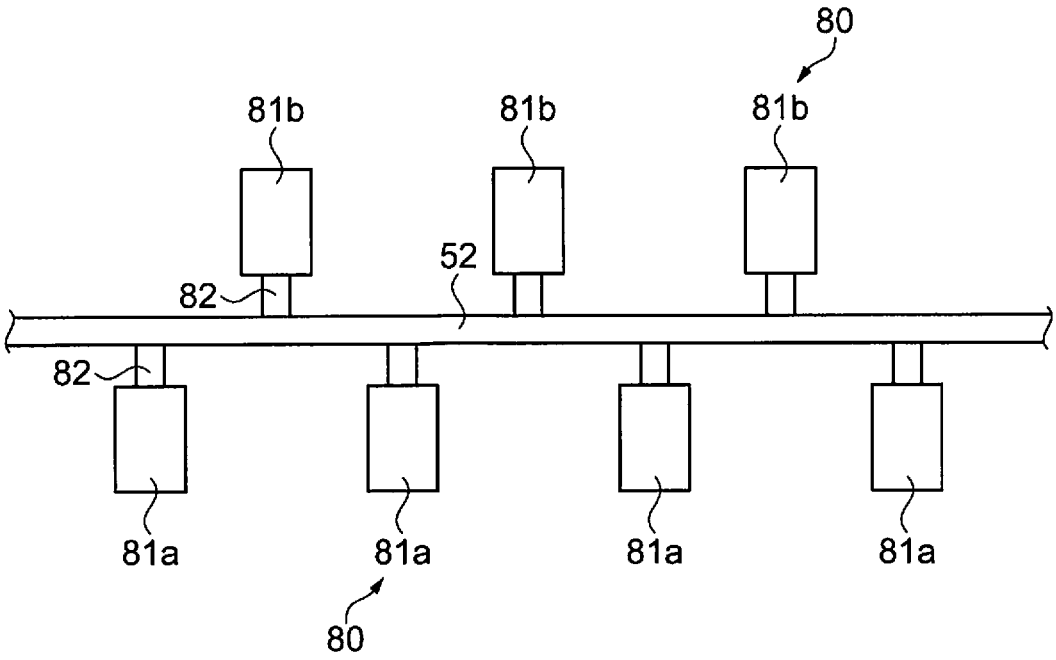
FIGS. 7A and 7B are schematic diagrams illustrating a configuration of a shape changing unit according to a first modified example.
Figure 7B:
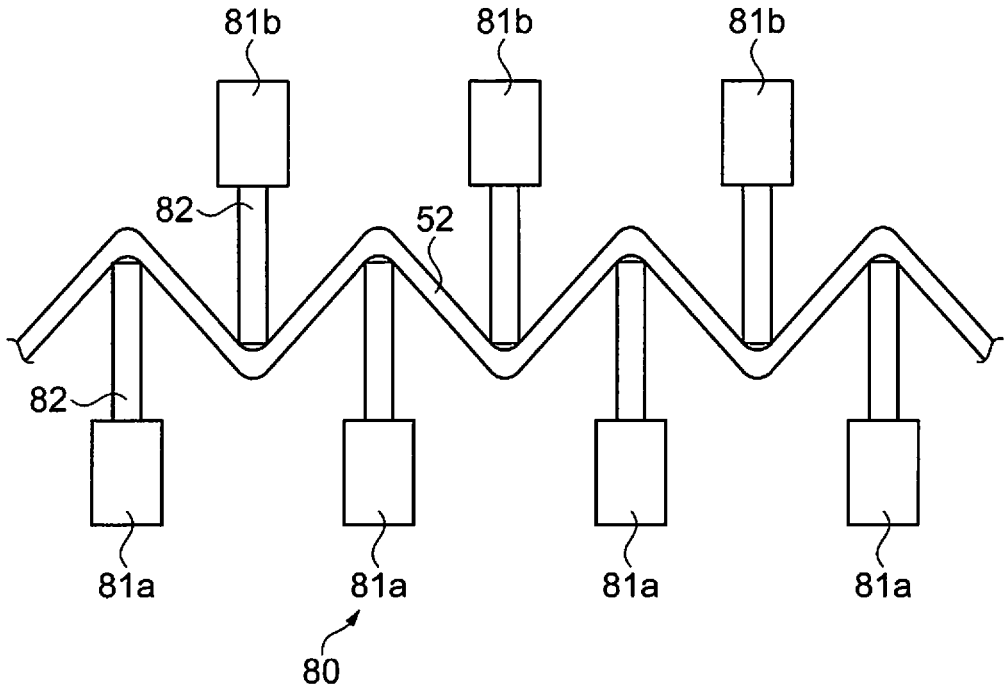

In the first and second embodiments described above, the plurality of solenoids 81*a* and solenoids 81*b* are alternately arranged along the ink supply path 52 and the solenoids 81*a* and the solenoids 81*b* are alternately driven, but the present invention is not limited to this. For example, the arrangement of the plurality of solenoids 81*a* and 81*b* may be changed, and furthermore, the driving method may also be changed. FIG. 7 is a schematic diagram illustrating a configuration of a shape changing unit according to modified example 1. As shown in FIG. 7A, the solenoids 81*a* and the solenoids 81*b* are arranged so as to face each other via the ink supply path 52. In addition, the solenoids 80*b* are arranged at positions which correspond to between two of the solenoids 80*a* which are adjacent to each other. Then, the solenoids 81*a* and 81*b* are driven at the same timing. Due to this, differences in elevation are formed with regard to the ink supply path 52 as shown in FIG. 7B. Also in this manner, since there is movement of the sedimentary material inside the ink supply path 52, it is possible to stir the ink.

Modified Example 2

Figure 8A:
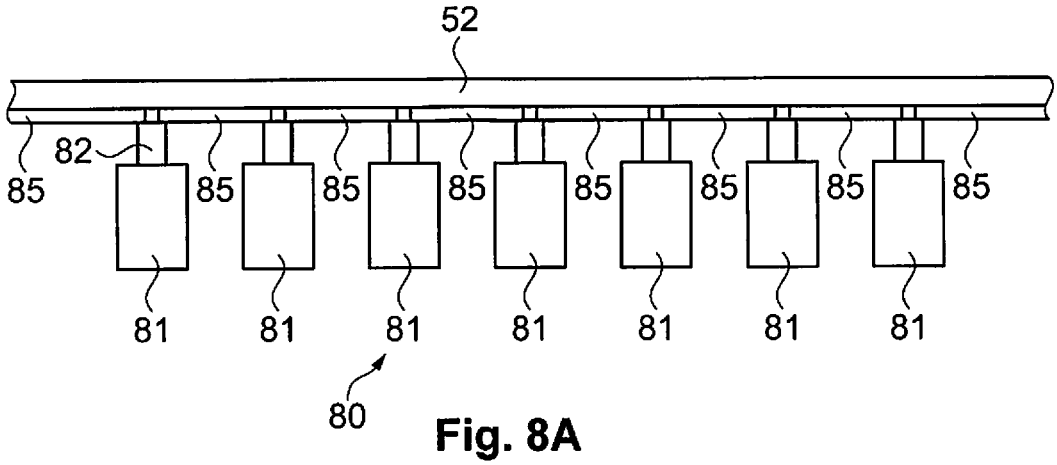
FIGS. 8A to 8C are schematic diagrams illustrating a configuration of a shape changing unit according to a second modified example.

The first and second embodiments described above have configurations where the solenoids 81*a* and 81*b* and the ink supply path 52 are in direct contact, but the present invention is not limited to this. For example, plate members 85 which are divided into predetermined sizes may be arranged between the solenoids 81*a* and 81*b* and the ink supply path 52. FIG. 8 is a schematic diagram illustrating a configuration of a shape changing unit according to modified example 2. As shown in FIG. 8A, the plate members 85 are arranged between the ink supply path 52 and the solenoids 81. Then, the plate members 85 are arranged at substantially the same intervals as the intervals between the adjacent solenoids 81. In the present embodiment, the plate members 85 which are adjacent are divided at positions which correspond to the plungers 82 of the solenoids 81.

Figure 8B:
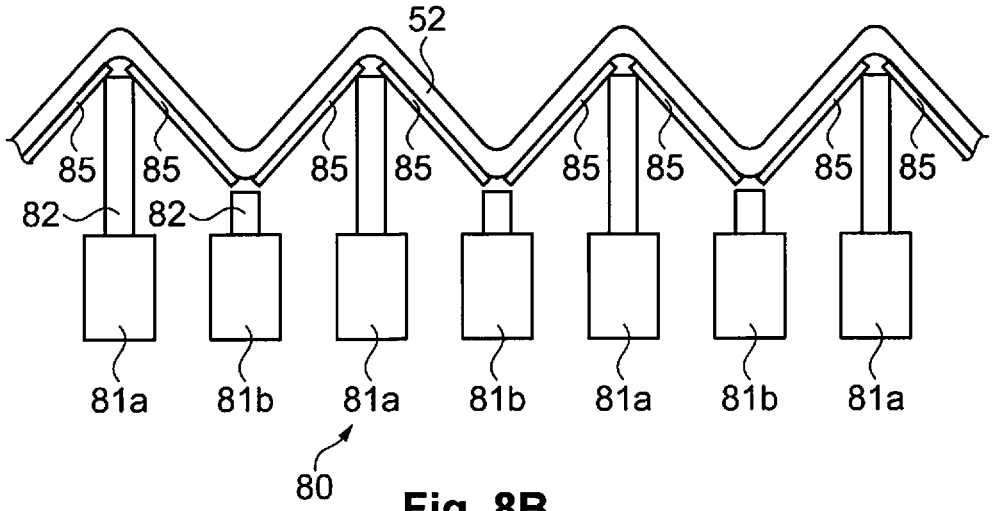

Then, firstly, the shape changing unit 80 which is configured in this manner drives the solenoids 81*a* at the first timing. At this time, the solenoids 81*b* are not driven. Due to this, the solenoids 81*a* which are driven extend upward in the vertical direction as shown in FIG. 8B. Then, the plungers 82 of the solenoids 81*a* push up the plate members 85. Then, a portion of the ink supply path 52 along the plate members 85 is pressed up. On the other hand, since the solenoids 81*b* are not driven, the ink supply path 52 is held in the initial position. Due to this, the shape of the ink supply path 52 is changed such that differences in elevation are formed in the direction of gravity. At this time, sedimentary material moves from a high position toward a low position in the ink supply path 52.

Figure 8C:
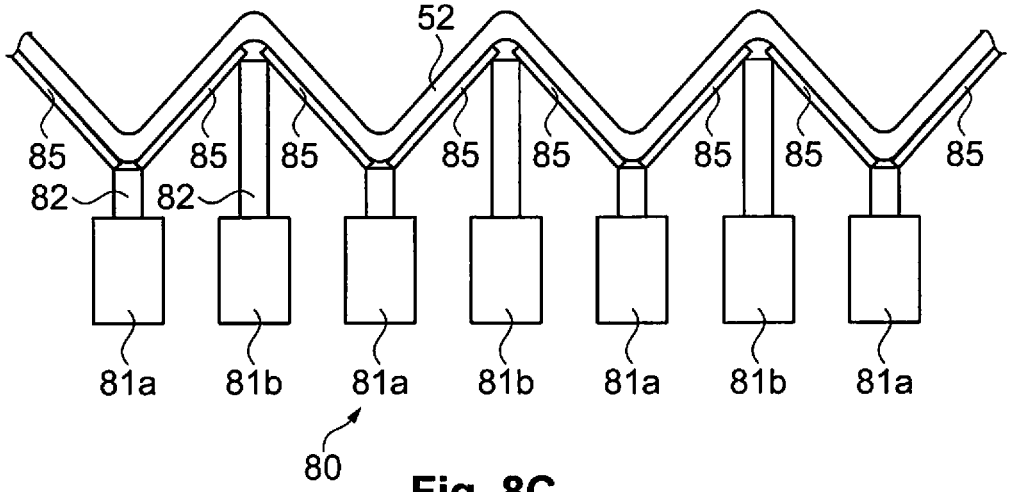

Next, the solenoids 81*a* are pressed down and the solenoids 81*b* are pressed up at the second timing which is after a predetermined time passes from the first timing. Due to this, as shown in FIG. 8C, the solenoids 81*a* move from the top to the bottom in the vertical direction, and accompanying this, the portion of the ink supply path 52 which corresponds to the solenoids 81*a* is pressed up from the top to the bottom. On the other hand, the solenoids 81*b* extend upward in the vertical direction. Then, the plungers 82 of the solenoids 81*b* push up the plate members 85. Then, a portion of the ink supply path 52 along the plate members 85 is pressed up. Due to this, the shape of the ink supply path 52 is changed such that differences in elevation are formed in the direction of gravity. At this time, sedimentary material moves from a high position toward a low position in the ink supply path 52. In this manner, it is possible to easily and reliably form differences in elevation with regard to the ink supply path 52.

Modified Example 3

Figure 9A:
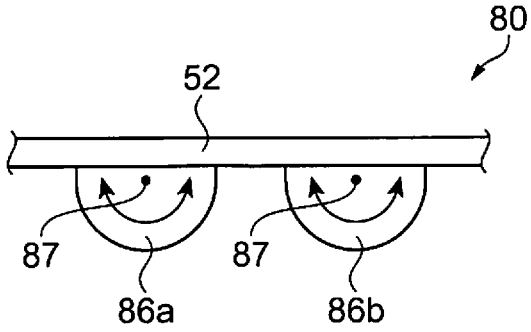
FIGS. 9A to 9C are schematic diagrams illustrating a configuration of a shape changing unit according to a third modified example.
Figure 9B:
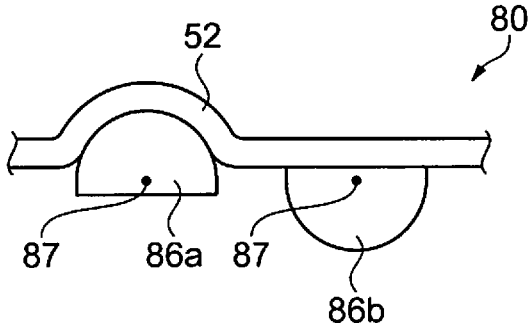

In the first and second embodiments described above, the solenoids 81 (81*a* and 81*b*) which change the shape of the ink supply path 52 using linear movement are applied as the shape changing unit 80, but the present invention is not limited to this. A rotary actuator which swings and rotates may be used as the shape changing unit which changes the shape of the ink supply path 52. FIG. 9 is a schematic diagram illustrating a configuration of a shape changing unit according to modified example 3. As shown in FIG. 9A, a plurality of rotary actuators 86*a* and 86*b* are arranged along the ink supply path 52. The rotary actuators 86*a* and 86*b* have a substantially hemispherical shape and each of the rotary actuators 86*a* and 86*b* is provided with a rotation shaft 87. Then, the rotary actuators 86*a* and 86*b* are configured so as to be able to rotate centering on the rotation shafts 87 based on a driving signal from the controller 60. Then, the rotary actuator 86*a* is driven at the first timing as shown in FIG. 9B. At this time, the rotary actuator 86*b* is not driven. Due to this, the rotary actuator 86*a* which is driven is rotated centering on the rotation shaft 87 as shown in FIG. 9B. Due to this, a portion of the ink supply path 52 is pressed up. On the other hand, since the rotary actuator 86*b* is not driven, the ink supply path 52 is held in the initial position. Due to this, the shape of the ink supply path 52 is changed such that differences in elevation are formed in the direction of gravity. At this time, sedimentary material moves from a high position toward a low position in the ink supply path 52.

Figure 9C:
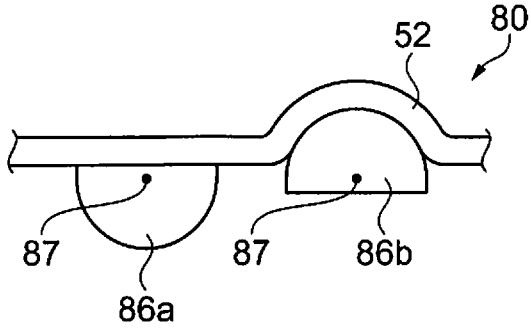

Next, the rotary actuator 86*a* is driven in a direction to the initial position and the rotary actuator 86*b* is driven at the second timing, which is after a predetermined time passes from the first timing, based on a driving signal from the controller 60. Due to this, the rotary actuator 86*b* which is driven rotates centering on the rotation shaft 87 as shown in FIG. 9C. Due to this, a portion of the ink supply path 52 is pressed up. On the other hand, the rotary actuator 86*a* returns to the initial position. Due to this, the shape of the ink supply path 52 is changed such that differences in elevation are formed in the direction of gravity. At this time, sedimentary material moves from a high position toward a low position in the ink supply path 52. Also in this manner, it is possible to easily change the shape of the ink supply path 52 and stir the ink in the same manner as the embodiments described above.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid droplet discharging apparatus comprising:

an ink tank configured to retain ink;

a head configured to discharge the ink;

a tubular ink supply unit defining an ink supply path, the tubular ink supply unit being configured to supply the ink from the ink tank to the head along the ink supply path; and a shape changing section configured to move the tubular ink supply unit to change a shape of the tubular ink supply unit between a first shape and a second shape different from the first shape such that differences in elevation are formed in a direction of gravity in the ink supply path.

2. The liquid droplet discharging apparatus according to claim 1, wherein the shape changing section includes a downward pressing part configured to press down the ink supply path in the direction of gravity.

3. The liquid droplet discharging apparatus according to claim 1, wherein the shape changing section includes a plurality of solenoids arranged along the ink supply path.

4. The liquid droplet discharging apparatus according to claim 3, wherein among adjacent two of the solenoids, one of the solenoids is pressed up and the other one of the solenoids is pressed down.

5. The liquid droplet discharging apparatus according to claim 1, further comprising a bypass flow path connected with the ink supply path, wherein the ink is circulated in a closed flow path between the ink supply path and the bypass flow path.

6. The liquid droplet discharging apparatus according to claim 1, wherein the shape changing section is configured to move at least one portion of the tubular ink supply unit from the first shape in which the portion extends straight to the second shape in which the portion has a curved shape.

7. The liquid droplet discharging apparatus according to claim 1, wherein the shape changing section includes a downward pressing part configured to move a first part of the tubular ink supply unit such that the first part is located downward in the direction from a second part of the tubular supply unit, which is different from the first part.

8. The liquid droplet discharging apparatus according to claim 1, further comprising a bypass flow unit defining a bypass flow path that is different from the ink supply path, the ink supply unit and the bypass flow unit defining a closed flow path in which the ink in the ink supply unit circulates.

* * * * *